US005699968A

United States Patent [19]

Hung

[11] Patent Number: 5,699,968

[45] Date of Patent: Dec. 23, 1997

[54] WATER DISCHARGE CONTROLLING STRUCTURE OF A SPRINKLING GUN

[75] Inventor: Tsang-Chung Hung, Changhua Hsien, Taiwan

[73] Assignee: Ruen Ryh Enterprise Co., Ltd., Changhua, Taiwan

[21] Appl. No.: 614,700

[22] Filed: Mar. 13, 1996

[51] Int. Cl.[6] ..... B05B 7/02

[52] U.S. Cl. ..... 239/526; 239/541; 239/583

[58] Field of Search ..... 239/288, 288.3, 239/288.5, 525, 526, 541, 569, 583, 530, 459

[56] References Cited

U.S. PATENT DOCUMENTS

| | | | |
|---|---|---|---|
| 2,937,813 | 5/1960 | Rinkewich | 239/526 |
| 3,670,967 | 6/1972 | Fahlin et al. | 239/525 |
| 4,219,162 | 8/1980 | Dadson | 239/583 |
| 4,676,437 | 6/1987 | Brown | 239/526 |
| 4,925,107 | 5/1990 | Brown | 239/526 |
| 5,160,092 | 11/1992 | Rose et al. | 239/530 |

*Primary Examiner*—Andres Kashnikow
*Assistant Examiner*—Lisa Ann Douglas
*Attorney, Agent, or Firm*—Bacon & Thomas

[57] ABSTRACT

A water discharge controlling structure of a sprinkling gun, in which a controlling bolt is slidably disposed in a barrel of the sprinkling gun and a nut is screwed with a rear end of the controlling bolt. The barrel has a rear end formed with two lateral axial shallow channels and two lateral arms of the U-shaped pushing plate are slidably received in the shallow channels. The pushing plate has a middle bridge portion formed with a key hole-shaped driving hole through which the controlling bolt is passed. The nut has a narrowed neck portion chucked in the key hole-shaped driving hole of the pushing plate. Each lateral arm has a free end formed with an outward bent engaging plate. A pivot seat is disposed on upper face of the barrel for pivotally connecting with two upward extending lugs of the trigger. Each lug is formed with an engaging slot for the engaging plate of the lateral arm of the pushing plate to engage therein. When operated, the trigger is pulled to urge the pushing plate to slide back and forth along the axial shallow channels of the barrel and a peripheral wall of the driving hole of the pushing plate drives the nut so as to slide the controlling bolt back and forth within the barrel without swinging the barrel for stably controlling the water flow.

1 Claim, 4 Drawing Sheets

WATER DISCHARGE CONTROLLING STRUCTURE OF A SPRINKLING GUN

BACKGROUND OF THE INVENTION

The present invention relates to a water discharge controlling structure of a sprinkling gun, in which a controlling bolt is slidably disposed in a barrel of the sprinkling gun and a nut is screwed with a rear end of the controlling bolt. A trigger is pulled to urge a pushing plate to slide back and forth along axial shallow channels of the barrel and a peripheral wall of a driving hole of the pushing plate drives the nut so as to slide the controlling bolt back and forth within the barrel without swinging the barrel for stably controlling the water flow.

FIG. 1 shows a conventional water discharge controlling structure of a sprinkling gun. A controlling bolt 12 is disposed in the barrel 11 of the sprinkling gun 10 and screwed with a nut 13 at rear end. A trigger 14 is pivotally connected to rear side of a grip 15. The trigger 14 is punched with a driving hole through which the bolt is passed. The peripheral wall of the driving hole serves drive the nut 13 so as to shift the controlling bolt 12 back and forth within the barrel 11 for controlling the water flow.

According to the above arrangement, the trigger 14 is pivotally connected to the rear side of the grip 15 and is held with trigger 14 attaching to the palm. The grip 15 is urged by the fingers to move toward the trigger 14. Therefore, the actually operated member is the grip 15 rather than the trigger 14 so that when operated, the sprinkling gun 10 will be swung as shown by the phantom line of FIG. 1. As a result, the sprinkled water beam will be swung and cannot be stably controlled.

SUMMARY OF THE INVENTION

It is therefore a primary object of the present invention to provide a water discharge controlling structure of a sprinkling gun, in which a controlling bolt is slidably disposed in a barrel of the sprinkling gun and a nut is screwed with a rear end of the controlling bolt. A trigger is pulled to urge a pushing plate to slide back and forth along axial shallow channels of the barrel and a peripheral wall of a driving hole of the pushing plate drives the nut so as to smoothly slide the controlling bolt back and forth within the barrel without swining the barrel for stably controlling the water flow.

The present invention can be best understood through the following description and accompanying drawings, wherein:

DETAILED DESCRIPTION OF THE PREFERRED EMBODIMENT

Figure 1:
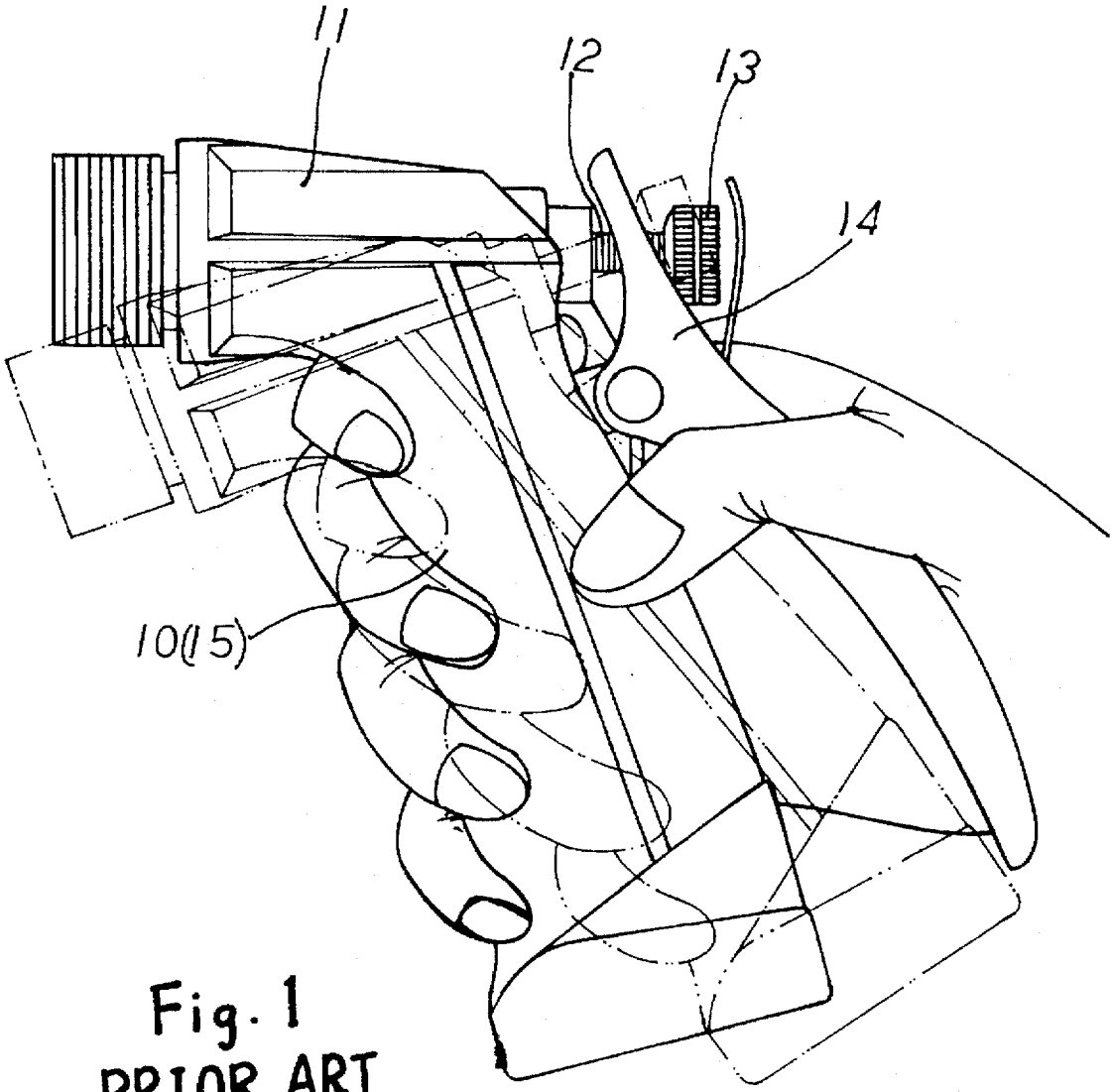
Fig. 1 PRIOR ART
FIG. 1 shows a conventional water discharge controlling structure of a sprinkling gun.
Figure 2:
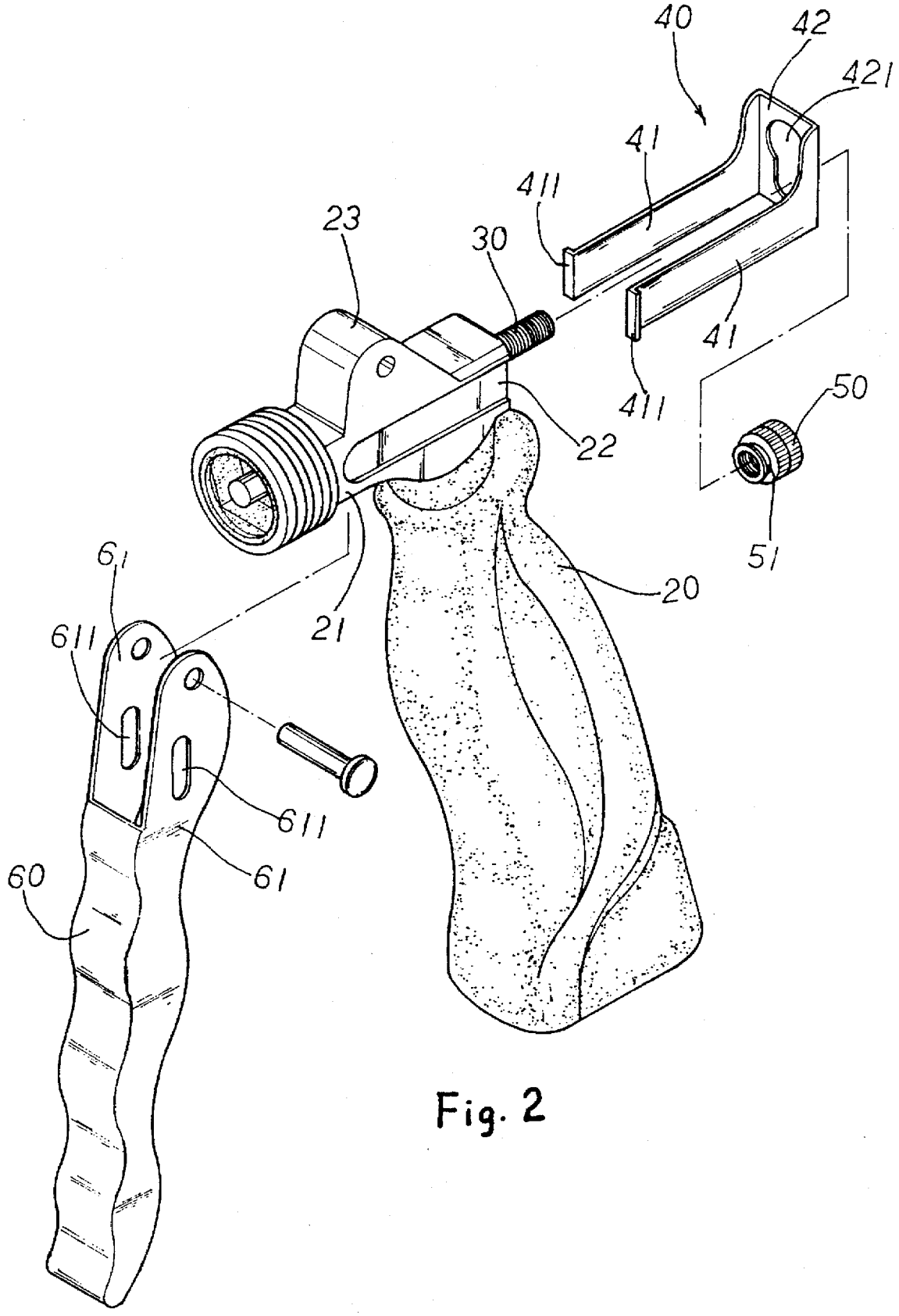
FIG. 2 is a perspective exploded view of the present invention.
Figure 3:
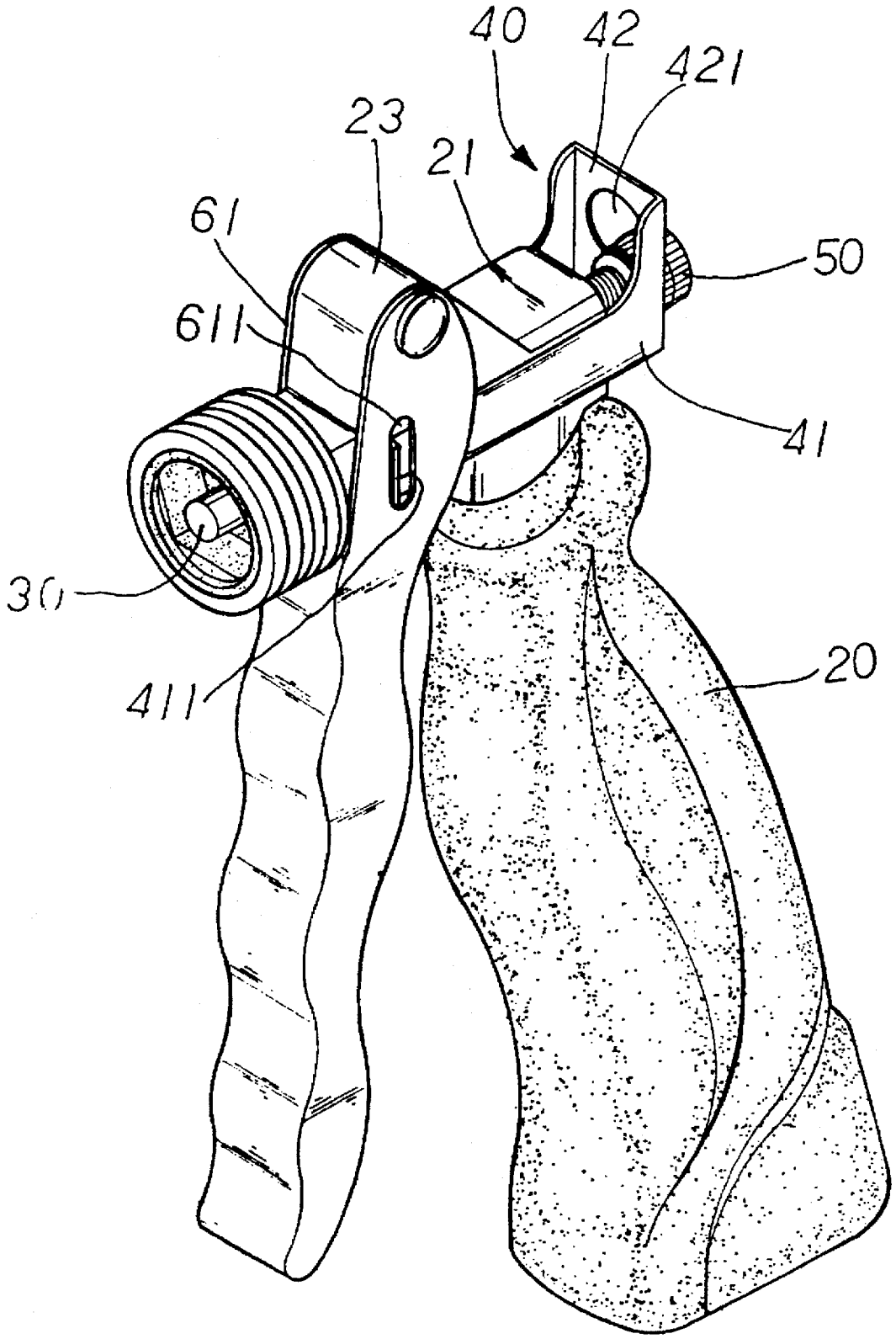
FIG. 3 is a perspective assembled view of the present invention.

Please refer to FIG. 2. In a preferred embodiment of the present invention, the barrel 21 of the sprinkling gun 20 has a rear end formed with two lateral axial shallow channels 22. Two lateral arms 41 of a U-shaped pushing plate 40 are slidably received in the shallow channels 22. The pushing plate 40 has a middle bridge portion 42 formed with a key hole-shaped driving hole 421 through which a controlling bolt 30 is passed. A nut 50 having a narrowed neck portion 51 is screwed with a rear end of the controlling bolt 30. The neck portion 51 is chucked in the driving hole 421 of the pushing plate 40. Each lateral arm 41 has a free end formed with an outward bent engaging plate 411. A pivot seat 23 is disposed on upper face of the barrel 21 for pivotally connecting with two upward extending lugs 61 of the trigger 60. Each lug 61 is formed with an engaging slot 611 for the engaging plate 411 of the lateral arm 41 of the pushing plate 40 to engage therein as shown in FIG. 3.

Figure 4:
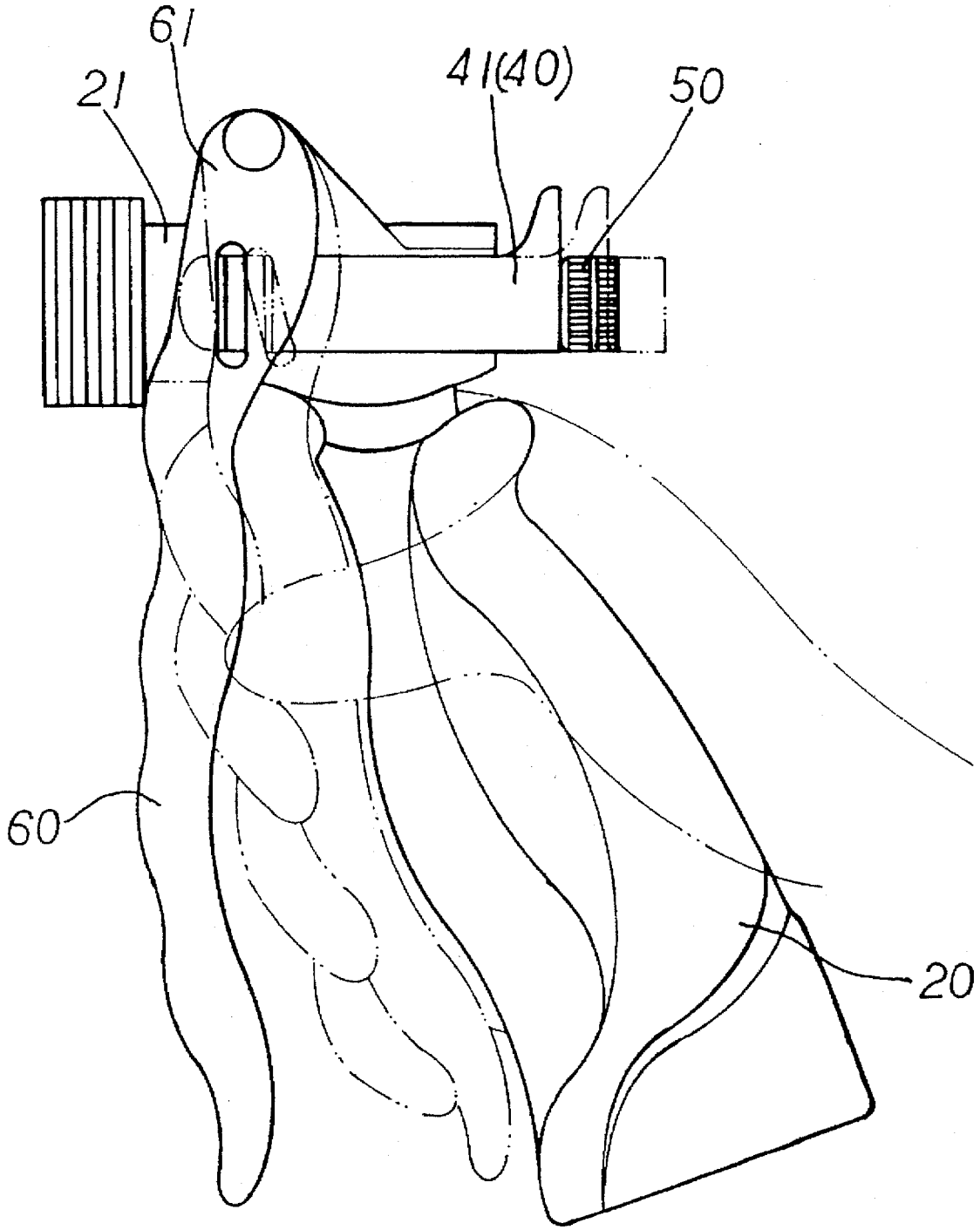
FIG. 4 shows the operation of the present invention.

Please refer to FIG. 4. When operated, the trigger 60 is pulled to urge the pushing plate 40 to slide back and forth along the axial shallow channels 22 of the barrel 21. Accordingly, the peripheral wall of the driving hole 421 of the pushing plate 40 drives the nut 50 so as to slide the controlling bolt 30 back and forth within the barrel 21 for controlling the water flow. When pulling the trigger, the lateral arms 41 of the pushing plate 40 are slided along and within the shallow channels 22 of the barrel 21 so that the triggering operation can be smoothly performed without swinging the barrel up and down.

The above embodiment is only an example of the present invention and the scope of the present invention should not be limited to the example. Any modification or variation derived from the example should fall within the scope of the present invention.

What is claimed is:

1. A water discharge controlling structure of a sprinkling gun, in which a controlling bolt is slidably disposed in a barrel of the sprinkling gun and a nut with narrowed neck portion is screwed with a rear end of the controlling bolt, said controlling structure being characterized in that:

the barrel has a rear end formed with two lateral axial shallow channels and two lateral arms of the U-shaped pushing plate are slidably received in the shallow channels, the pushing plate having a middle bridge portion formed with a key hole-shaped driving hole through which the controlling bolt is passed, the narrowed neck portion of the nut being chucked in the driving hole of the pushing plate, each lateral arm having a free end formed with an outward bent engaging plate, a pivot seat being disposed on upper face of the barrel for pivotally connecting with two upward extending lugs of the trigger, each lug being formed with an engaging slot for the engaging plate of the lateral arm of the pushing plate to engage therein, whereby when operated, the trigger is pulled to urge the pushing plate to slide back and forth along the axial shallow channels of the barrel and a peripheral wall of the driving hole of the pushing plate drives the nut so as to slide the controlling bolt back and forth within the barrel for controlling the water flow.

* * * * *